United States Patent [19]

Sawaki et al.

[11] Patent Number: 4,480,195

[45] Date of Patent: Oct. 30, 1984

[54] AUTOMATIC SHUT-OFF DEVICE OF A RECORDING APPARATUS

[75] Inventors: Akira Sawaki; Hiromi Nozaki, both of Hachioji, Japan

[73] Assignee: Konishiroku Photo Industry Co., Ltd., Tokyo, Japan

[21] Appl. No.: 453,284

[22] Filed: Dec. 27, 1982

[30] Foreign Application Priority Data

Dec. 31, 1981 [JP] Japan ..... 56-213084

[51] Int. Cl.[3] ..... H01H 9/54

[52] U.S. Cl. ..... 307/140; 307/141.4; 307/141.8; 355/69; 355/14 R

[58] Field of Search ..... 355/69, 14 R; 307/141.4, 141.8, 140, 141

[56] References Cited

U.S. PATENT DOCUMENTS 4,089,602 5/1978 Noguchi et al. ..... 355/69

4,270,058 5/1981 Schornack ..... 307/140

FOREIGN PATENT DOCUMENTS 2854915 6/1979 Fed. Rep. of Germany .... 355/14 R

*Primary Examiner*—L. T. Hix

*Assistant Examiner*—Della J. Rutledge

*Attorney, Agent, or Firm*—Jordan B. Bierman

[57] ABSTRACT

An automatic shut-off device for a recording apparatus such as a copying machine has a commercial power source for powering the machine during an ON-state, charging means connected to the power source for charging a battery, control means for providing a first signal for an ON-state and a second signal for an automatic shut-off state, first means responsive to said first signal to effect charging of said battery, and second means responsive to said second signal to electrically disconnect the commercial power source, and to supply an output power from said battery for selected operational control functions for the period of said automatic shut-off state. Thus, in the automatic shut-off state, the machine maintains certain operational control functions, such as low power displays, powered by the battery but is disconnected from the commercial power source, thereby reducing the risk of an accident such as a short circuit.

2 Claims, 1 Drawing Figure

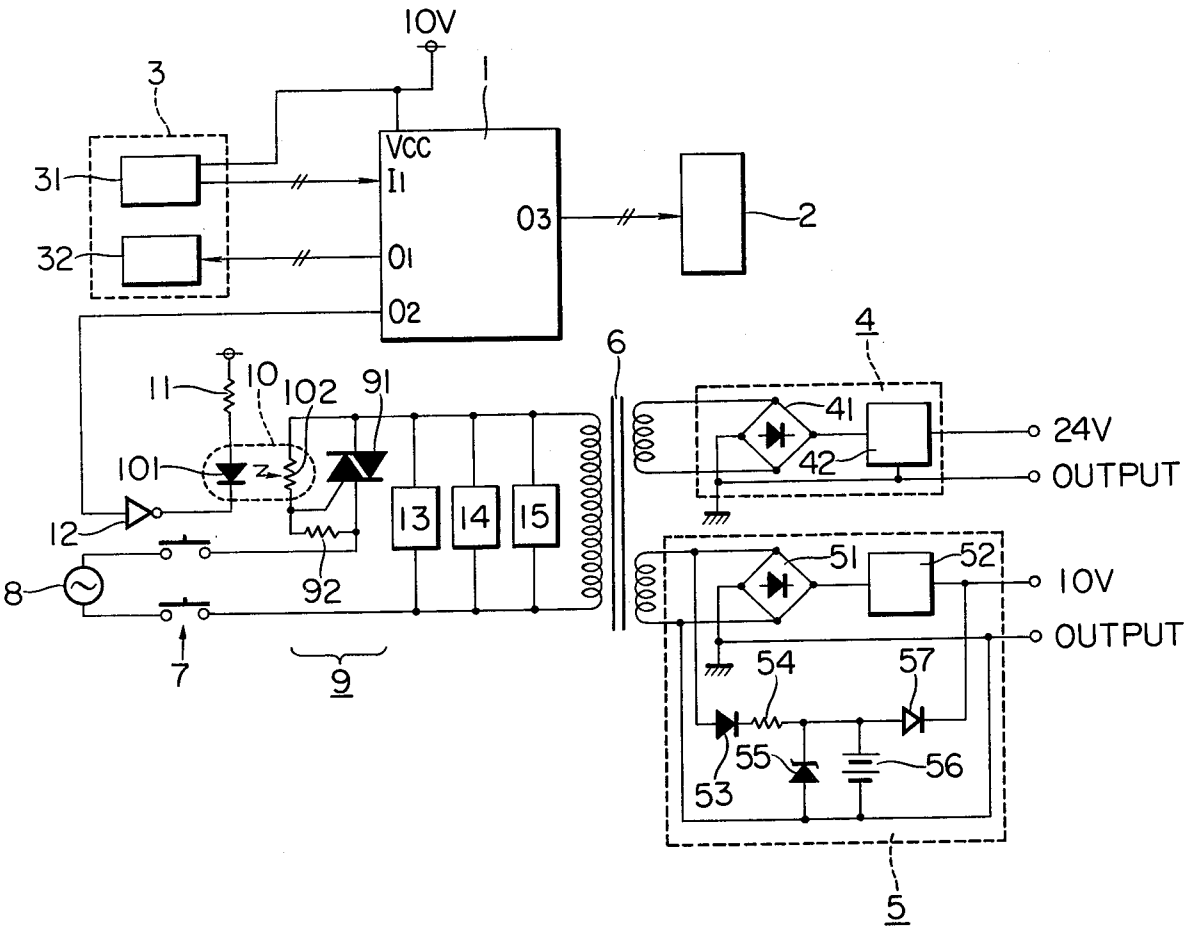
10V
Vcc
I1
O1
O2
O3
1
2
3
31
32
4
41
42
24V
OUTPUT
5
51
52
53
54
55
56
57
10V
OUTPUT
6
7
8
9
91
92
10
101
102
11
12
13
14
15

AUTOMATIC SHUT-OFF DEVICE OF A RECORDING APPARATUS

BACKGROUND OF THE INVENTION

1. Field of the Invention

The present invention relates to an automatic shut-off device of a recording apparatus, which shuts off the power source when a certain period of time elapses after completing an image recording such as a copying operation.

2. Description of the Prior Art

Recently, there has been developed a tendency to equip an automatic shut-off device to a recording apparatus such as a copying apparatus, in order to meet the requirement for economizing on electric power consumption. In the conventional types of automatic shut-off devices, the electric power supply from a commercial power source is not all stopped for the period of the automatic shutting-off, but is supplied even during the shutting-off period at least to a micro-computer forming a part of the control section, wherein the commercial power voltage is stepped down, rectified and stabilized.

On the other hand, for such a shutting-off period, the indicators and the like of an operation control section are turned off, so that it is not apparent to an operator whether or not the power sources of the recording apparatus is on. In an office and the like there are frequent instances where the main switch is not switched off at closing time. In addition, it is hardly expected to pull out the power plug from the socket at closing time. There has been a serious danger with the conventional apparatuses of an accident such as a short-circuit inside the recording apparatus.

SUMMARY OF THE INVENTION

The invention has been accomplished from the viewpoints mentioned above, and it is an object of the invention to provide an automatic shut-off device of a recording apparatus, wherein all the power sources in the apparatus generated from a commercial power source are cut off for the period of the automatic shutting-off so that the safety of the apparatus can be secured against such an accident as a short-circuit.

The automatic shut-off devices relating to the invention are characterized by provision of a battery that is in a charging state for the period other than the automatic shutting-off state and is electrically disconnected from a commercial power source for the period in the shutting-off state. A power voltage from the battery is supplied section at least for the period in the automatic shutting-off state. For a better understanding of the present invention together with its other and further features, reference is made to the following description, taken in conjunction with the accompanying drawing.

BRIEF DESCRIPTION OF THE DRAWING

The diagram shows an example in which an automatic shut-off device relating to the invention is applied to a copying apparatus.

DETAILED DESCRIPTION OF THE PREFERRED EMBODIMENT

The diagram shows the constitutional parts of the copying apparatus. Reference numeral 1 designates a control section in which a micro-computer is used. Driving section 2 comprises a fixing controller, exposure controller, high voltage unit, motor driving unit and the like which are regulated by control section 1. Operation unit 3 comprises key input 31 and display unit 32. In driving power circuit 4, an A.C. voltage is obtained from a secondary winding of transformer 6, is full-wave rectified by diode bridge 41, and is then converted into a D.C. voltage of 24 V to output by constant voltage circuit 42. Control power circuit 5 takes an A.C. voltage from the other secondary winding of transformer 6, which is full-wave rectified by diode bridge 51 and then converted into D.C. voltage of 10 V to output by constant voltage circuit 52. In this control power circuit 5, battery 56 is charged with a voltage obtained by rectifying the aforementioned A.C. input voltage through diode 53 and resistor 54. The output from the battery is connected in parallel to the output of constant voltage circuit 52 through diode 57. Battery 56 is for 10.5–11 V and is connected in parallel with Zener diode 55 so as to charge at a Zener voltage of not lower than 10.6 V. To the abovementioned driving section 2 and display unit 32 of operation unit 3, the output voltage of 24 V is supplied respectively from driving power circuit 4 to serve as the power voltage. To control section 1 and key input 31 of operation unit 3, the output voltage of 10 V is supplied respectively from control power circuit 5 to serve as the power voltage.

To the primary winding of transformer 6, the voltage from commercial power source 8 is supplied through main switch 7 which is switched on and off manually. Between main switch 7 and one end of the primary winding, there is connectedly inserted Triac circuit 9 which is controlled by photocoupler 10. To photocoupler 10, the power voltage of 10 V is supplied from control power circuit 5 through resistor 11 and the photocoupler is driven by inverter 12 which receives the output from control section 1. For example, when the output of output port $O_2$ of control section 1 becomes "H", the output of inverter 12 becomes "L" and then light emission diode 101 of photocoupler 10 is turned on, and thus the resistance value of internal resistor 102 in a detector on the photoreception side such as a CdS cell is reduced. Accordingly, the step-down voltage generated by commercial power source 8 is reduced by resistor 102, and Triac 91 is in the ON-state and thus the voltage of the commercial power source is applied to transformer 6 through Triac 91. On the contrary, when the output of output port $O_2$ of control section 1 becomes "L", the voltage step-down is increased at resistor 102 of photocoupler 10 and Triac 91 is in the OFF-state. Therefore no more than an extremely weak current is provided to transformer 6 through resistor 102 and thus the application of the commercial power voltage becomes substantially cut-off to transformer 6.

The the latter part of Triac circuit 9, a fixing heater drive by the commercial power voltage, as well as the temperature controller 13 thereof, main motor 14, an exposure lamp, as well as the driving circuit 15 thereof and the like are connected in parallel with transformer 6, respectively.

With reference to the operation of this device of the invention as explained above, in the state that main switch 7 is ON and a commercial power is supplied to a copying apparatus, and for the period of a copying operation, output port $O_2$ of control section 1 is at "H", light emission diode 101 is driven, and Triac 91 is in the ON-state. Accordingly, electric power is supplied to a fixing heater and the temperature controller 13 thereof, main motor 14, an exposure lamp and the driving circuit 15 thereof and the like from commercial power source 8. At the same time an A.C. voltage is given to power circuits 4 and 5, respectively, through transformer 6, and thus the voltage of 24 V and 10 V are generated. For the period in the abovementioned operations, battery 56 is in the charging state.

When a copying operation is completed once, control section 1 computes clock pulses and counts the lapse of time. When there is given a certain signal within a limited period of time, say two minutes, from a copy-start button and the like including buttons for magnification copying, density adjusting, etc., so as to resume copying, then control section 1 clears off the computed values and then enters in the operational state as mentioned above. On the other hand, when the limited period of time elapsed as the aforementioned signal for resuming copying is not yet given, then the output signal from output port $O_2$ is changed to "L" to stop drive unit 2, display 32 and photocoupler 10. Thus control section 1 enters in an automatic shut-off state. Triac 91 is in the OFF-state by neutralizing photocoupler 10 and it is now in the state where the electric supply from a commercial power source is shut off. Thereby, the electric supply is shut-off to a fixing heater and the temperature controller 13 thereof and others, and at the same time, the electric supply to transformer 6 is also shut off and the output of constant voltage circuits 42 and 52 are stepped down to zero, respectively. Thus, every electric supply to the parts where the electric consumption is relatively large, except some parts of the copying apparatus, are shut-off, and the output voltage of 10 V from battery 56 is supplied as the power voltage to control section 1, key input 31 and photocoupler 10 to maintain them in the operational state. In this example, display 32 is turned off for the period in the automatic shut-off state. However, if display 32 comprises one consuming relatively less electricity, such as a liquid crystal display element, and receives electric supply from control power circuit 5 for the period in the automatic shut-off state, it is possible to make display 32 indicate that the situation is in the automatic shut-off state.

In such an automatic shut-off state as mentioned above, and when an information is inputted from key input 31, then control section 1 received the signal, discriminates the contents of the information, changes the output signal of output port $O_2$ to "H" to release the shut-off state, restores Triac 91 into the ON-state and thus resumes a copying process. For example, when a copy quantity selection is inputted as "5" from key input 31, the selected copy quantity "5" is displayed on display 32 and the other displays are also re-generated. Simultaneously, the power supply is resumed to every portion of the copying apparatus, which is restored to be ready for copying after warming up the fixing heater.

As explained above, it is possible in the invention to make the state equivalent to that of the commercial power source being completely shut-off. The power voltage is supplied from a battery to control section 1 for the period in the shut-off state. Accordingly, even if a main switch is not switched off, it is possible to prevent the risk of fire caused by a short-circuit or the like.

What is claimed is:

1. An automatic shut-off device for shutting off a power source in an apparatus such as a copying machine, comprising:

charging means connected to the power source for charging a battery;

control means for providing a first signal for an On-state, and a second signal for an automatic shut-off state of said apparatus;

first means responsive to said ON-state signal for powering said apparatus and charging said battery;

second means responsive to said automatic shut-off state signal for electrically disconnecting the power source, and applying an output power from said battery to selected operational control functions during the period of said automatic shut-off state of said apparatus.

2. The automatic shut-off device of claim 1, wherein said operational control functions include low power display elements for said apparatus.

* * * * *